US006634830B1

(12) United States Patent
Marshall

(10) Patent No.: US 6,634,830 B1
(45) Date of Patent: Oct. 21, 2003

(54) METHOD AND APPARATUS FOR POST-TENSIONING SEGMENTED CONCRETE PILINGS

(76) Inventor: Frederick S. Marshall, 1710 Cove Meadow Ct., Arlington, TX (US) 76012

( * ) Notice: Subject to any disclaimer, the term of this patent is extended or adjusted under 35 U.S.C. 154(b) by 23 days.

(21) Appl. No.: 09/666,216

(22) Filed: Sep. 21, 2000

(51) Int. Cl.[7] ..... E04C 5/20; E04C 5/74; F16B 2/02; F16B 2/22

(52) U.S. Cl. ..... 405/244; 405/255; 403/368; 403/371; 403/374.1; 52/223.13

(58) Field of Search ..... 405/230, 231, 405/244, 249–252, 255, 256; 403/367, 368, 371, 373, 374.1; 52/223.13, 223.14, 169.9

(56) References Cited

U.S. PATENT DOCUMENTS

| | | | | | |
|---|---|---|---|---|---|
| 2,646,090 | A | | 7/1953 | Kinneman et al. | 405/232 |
| 3,899,891 | A | | 8/1975 | Kelly et al. | 405/251 |
| 4,896,470 | A | * | 1/1990 | Sorkin | |
| 5,259,703 | A | * | 11/1993 | Gillespie | 405/302.2 X |
| 5,288,175 | A | | 2/1994 | Knight | 405/230 |
| 5,399,055 | A | | 3/1995 | Dutton, Jr. | 405/230 |
| 5,505,561 | A | * | 4/1996 | Wilcox, III | 405/251 |
| 5,511,909 | A | * | 4/1996 | Calandra, Jr. et al. | 405/259.1 X |
| 5,802,788 | A | * | 9/1998 | Ozawa et al. | 52/223.13 |
| 6,017,165 | A | * | 1/2000 | Sorkin | 52/223.13 X |
| 6,023,894 | A | * | 2/2000 | Sorkin | 52/223.13 X |
| 6,027,278 | A | * | 2/2000 | Sorkin | 52/233.13 X |
| 6,234,709 | B1 | * | 5/2001 | Sorkin | 52/223.13 X |

* cited by examiner

*Primary Examiner*—Robert E. Pezzuto
*Assistant Examiner*—Tara L. Mayo
(74) *Attorney, Agent, or Firm*—Bracewell & Patterson, L.L.P.

(57) ABSTRACT

A foundation repair piling made up of segments is post tensioned by a cable fed into the segments after the piling is installed. A cable anchor serves as a base segment of multiple concrete piling segments. After installing all the concrete segments on top of the base segment, a cable is inserted into passages in the segments. The cable is threaded through the completely installed piling segments and into the cable anchor. After the cable bottoms out in the cable anchor, upward tension is applied to the cable. As the cable is pulled, cable lock members in the cable anchor increase gripping pressure even as the cable tension increases, thereby solidly anchoring the end of the cable in the cable anchor. After the desired tension is reached, the cable is terminated at the top of the last segment. The tension is held by a termination lug at the top end of the cable.

11 Claims, 3 Drawing Sheets

METHOD AND APPARATUS FOR POST-TENSIONING SEGMENTED CONCRETE PILINGS

BACKGROUND OF THE INVENTION

1. Technical Field

The present invention generally relates to structure foundations and in particular to pilings that are utilized to support the foundations. Still more particularly, the present invention relates to segmented pilings.

2. Description of the Related Art

Many structures have been built on foundations or slabs made of concrete poured on top of soil. Constant changes in the weather and moisture levels in the soil frequently cause damage to such a foundation. In many instances, the foundation may buckle or even crack. This phenomenon occurs for a variety of reasons, including uneven changes in the water content of supporting soils, uneven compacting of soils, and uneven loads being placed on soils. Over time, uneven movement in the soils under a foundation can cause a foundation to bend or crack.

There are several methods used in repairing foundations. One of the most effective and widely used methods includes the use of one or more piles driven into the soil beneath a foundation to form one or more supports. Most of the supports are made primarily of concrete and have an overall cylindrical shape with length and diameter varying according to the soil type and the weight of the structure. For clarity, the words "piling section" and "section" signify a single cylindrical piece, and the words "pile" and "piling" signify a plurality of sequentially stacked pieces (sections) to form a single support column. A plurality of piles or pilings provide overall load support for a structure in the form of a piling system.

One of the most successful foundation repair procedures involves excavating, or partially excavating, underneath the grade beams that need to be supported or raised, placing a concrete or steel piling section in the excavated cavity underneath the grade beam, placing a construction jack between the grade beam and the piling section, and then operating the jack by hydraulic or pneumatic action to force the piling section downward into the ground while pushing against the bottom of the grade beam. Once the piling section is driven sufficiently into the ground so that its top is flush with the bottom of the excavated area, another piling section is put in place on top of the previous piling section and the jack is reactivated. Eventually, either the piling made up of the piling sections will hit a competent load bearing strata, or the combination of the skin friction between the piling and the ground and the resistance at the end of the piling will make it impossible to the piling any further.

Prior art utilizes piling systems, for foundation support, that are still in use today. For instance U.S. Pat. Nos. 2,645,090 and 3,899,891 describe inventions for assembling segmented pilings on site and then connecting the piling segments to each other with post tensioned cables. Both inventions contemplate tensioning the cable before the piling is driven. U.S. Pat. No. 5,399,055 describes a means for reinforcing a segmented piling, after the piling has been driven into the ground. U.S. Pat. No. 5,288,175 describes a system for driving segmented concrete pilings into the ground while concurrently threading the piling sections onto a cable. After the piling is driven, the cable can be tensioned.

The current art has problems. The sections are strung onto the cable above ground, generally next to the excavation.

Threading each piling section onto the cable is labor intensive. Each piling section must be threaded onto the cable and moved along the length of the cable. Enough space must be available to perform the operation. Since cable lengths are typically a minimum of 25 feet, a considerable amount of working room is needed adjacent to the excavation. The ultimate length of the piling is not known before the piling is driven, and the length of precut cable sections will not match the length of the piling. If the cable is too long, material is wasted; if the cable is too short, the piling will not be properly reinforced or tensioned. Piling sections must be small enough for threading along the cable.

When driving a piling section, it is necessary to avoid placing pressure directly on the cable. This is accomplished by using a "bending template" as described by Knight, or by placing a driving ram (used to push a piling into the ground) in an off center position to avoid the cable. Using the "bending template" is labor intensive. Placing the driving ram in an off center position increases the failure rate of piling segments and can cause pilings to deviate from a vertical orientation as they are driven.

Therefore it would be desirable to provide a method and apparatus that would eliminate the specified pre-cut cable lengths for a piling with a plurality of sections. It would also be desirable to eliminate the need for a bending template. It would desirable to provide a cable anchor device that would eliminate the need to thread piling sections on the cable and still provide a positive lock on the end of the cable.

SUMMARY OF THE INVENTION

It is therefore one object of the present invention to provide a post-tensioned, segmented, concrete piling.

It is another object of the present invention to utilize a cable for post-tensioning a segmented piling system without the necessity for a bending template.

It is yet another object of the present invention to provide a cable anchor that will provide a positive lock on a cable that is utilized for post-tensioning a segmented piling system, where the cable is installed after the piling is driven.

The foregoing objects are achieved as is now described. The invention comprises a cable anchor as a base segment for multiple concrete piling segments. After installing all the concrete segments on top of the cable anchor, a cable is inserted into passages in the segments to provide post tensioning to the piling. The cable is threaded through the completely installed piling segments and into the cable anchor. After the cable bottoms out in the cable anchor, upward tension is applied to the cable. As the cable is pulled, cable locking members in the cable anchor increase gripping pressure even as the cable tension increases, thereby solidly anchoring the end of the cable in the cable anchor. After the desired tension is reached, the cable is terminated at the top of the last segment. The top end of the cable is then held in place by a termination lug.

The exterior of the cable anchor is a metal cylinder with an end plate on the bottom of the cylinder. Inside the cylinder is an insert that has a bore shaped like the interior of an hourglass with two truncated conical bore sections, wherein the smaller diameters are connected by a cylindrical bore section. The lower truncated conical section is shaped so that two half-conical cable lock members will fit tightly into said conical opening. The portion of the lower conical bore section that is not occupied by the cable lock members is filled with a conical resilient rubber pad.

In the present invention, each cable lock member consists of one half of a cone, where such cone has been split along the long axis of the cone that passes from the tip of the cone through the center of the bottom of the cone. A flat face is formed where the cone is split. A semi-cylindrical groove is cut into the flat face of each half cone such that the groove passes from the tip of the half cone down to the bottom of the half cone. The groove is cut parallel to the long axis of the half cone and passes from the tip of the half cone to the center of the bottom edge of the flat face of the half cone. Teeth are formed in the groove pointing inward to the center of the groove and downward away from the top of the cone.

When pressed together, the two lock members form a cone with a cylindrical opening that passes through the top of the cone, along the vertical axis of the cone, and out through the center of the bottom of the cone.

The upper conical opening in the insert, the cylindrical passage in the center of the insert, the lower conical opening in the insert, the cylindrical opening through the lock members, and a cylindrical opening in the resilient pad are all filled with oil, grease, or other agents designed to protect the end of the cable from corrosion. All the open space in the insert is filled with a rust inhibitor.

A cable is inserted through a channel, conduit, guide, or similar opening, that leads the end of the cable into the top opening of the cable anchor. The sloping sides of the top hollow truncated conical bore section in the insert guide the cable into the cylindrical passage, which connects the top conical bore section to the bottom conical bore section. The cable is then pushed into said cylindrical passage.

The cylindrical passage directs the end of the cable through the lock members into a cavity below the lock members. The two lock member are held in place by the resilient pad. The pad acts as a spring to hold the lock members in place and also allows the lock member to be pushed downward while a cable is being pushed through the cable lock members. The anchor is similar to a finger trap in that the harder the cable is pulled, the more firmly the anchor grips the cable.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
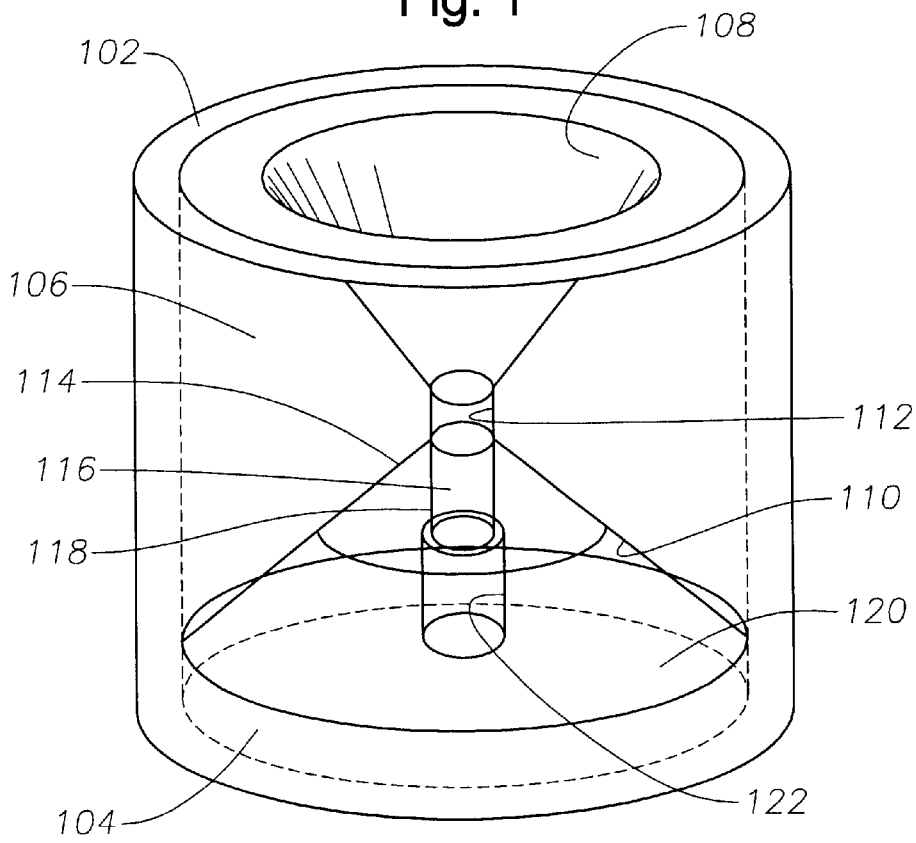
FIG. 1 is a schematic isometric view of a cable anchor in accordance with a preferred embodiment of the present invention.
Figure 2:
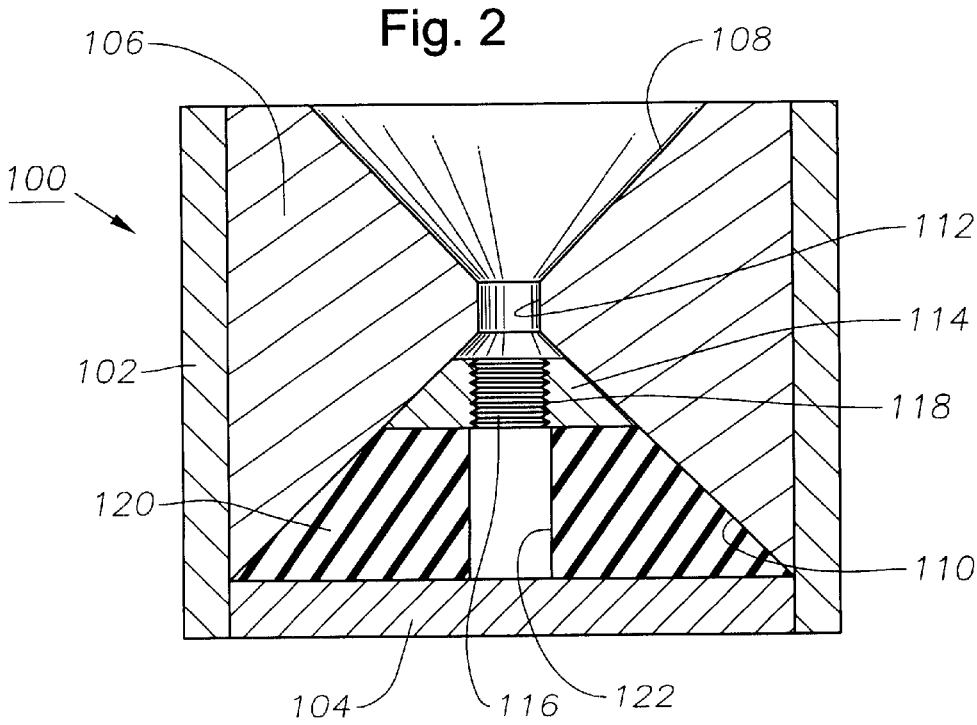
FIG. 2 is a sectional view of the cable anchor of FIG. 1.

With reference now to the figures, and in particular with reference to FIGS. 1 and 2, a cable anchor in accordance with a preferred embodiment of the present invention, is depicted. Cable anchor assembly 100 comprises an exterior cylinder 102 having a cylindrical bore, an end plate 104 and an insert 106. Cylinder 102 is preferably metal and is open on the top and enclosed on the bottom with end plate 104. Insert 106 is located within the bore of cylinder 102 and comprises a cylindrical section containing two hollow truncated conical bore sections, an upper conical bore section 108 and a bottom conical bore section 110. The larger diameter of upper conical bore section 108 is located on the top of insert 106. The lower end of upper conical bore section 108 communicates with lower conical bore section 110 via a cylindrical passage 112 formed in insert 106.

A pair of cable lock members 114 are installed at the lower opening of cylindrical passage 112. Cable lock members 114 comprise two halves of a truncated cone. Each lock member 114 has an axial semi-cylindrical recess formed in a flat wall, resulting in a cylindrical passage 116 formed within cable lock members 114 when the flat walls of lock members 114 are abutted together as shown. The smaller diameter of lock members 114 is located on the upper end. The exterior of each lock member 114 slidingly mates with lower conical bore section 110. The interior wall of cylindrical opening 116 has saw-tooth shaped teeth 118 extending inward and downward toward the axis of cylindrical opening 116. When inserted into lower conical bore section 110, cylindrical opening 116 aligns with cylindrical passage 112 along the vertical axis of anchor assembly 100.

A truncated conical resilient pad 120 of neoprene or rubber is pressed between end plate 104 and the bottom of cable lock members 114. Resilient pad 120 has a flat top that abuts the flat bottoms of lock members 114, and a flat bottom that abuts end plate 104. The conical side wall of resilient pad 120 mates with lower conical bore section 110 of insert 106. Resilient pad 120 has an axial cylindrical passage 122 aligned with cylindrical passage 116 of lock members 114. Oil, grease or any other rust inhibitor of choice fills both conical openings 108 and 110, cylindrical passages 112 and 122, and cylindrical passage 116 to prevent corrosion of an installed cable end.

Figure 3:
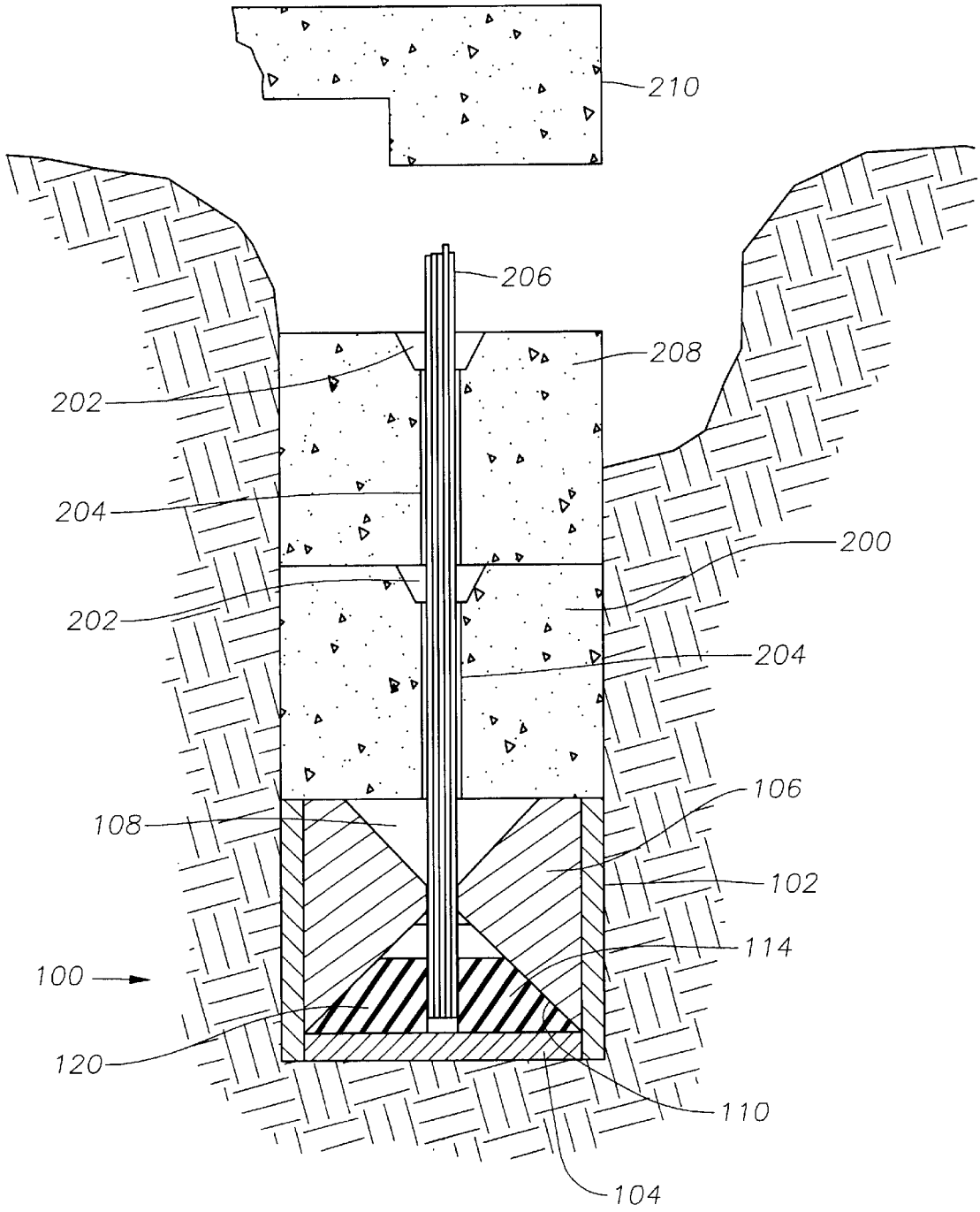
FIG. 3 is schematic sectional view of the cable anchor of FIG. 1 installed in is accordance with a preferred embodiment of the present invention.

Referring also to FIG. 3, cable anchor 100 is the first member installed in a piling installation. A first of several cylindrical piling segments 200 is then placed on top of cable anchor 100. Each segment 200 has a cable passage 204 extending therethrough with a conical upper end 202. Cable passage 204 is aligned with the hollow truncated conical bore section 108 of anchor assembly 100. A second piling segment 200 is then installed, and cable passage 204 of the second segment is aligned with the conical upper end 202 of cable passage 204 of the first piling segment 200. Piling segments 200 are added until the proper length is attained.

Cable 206 is then threaded downward through passage 204 in each segment until cable 206 reaches cable anchor 100. Cable 206 is pushed through hollow truncated conical bore 108, passage 116 of cable lock members 114 and into cylindrical hole 122 in resilient pad 120. As cable 206 is forced through passage 116 of cable lock members 114, downward pointing teeth 118 allow downward movement of cable 206. Resilient pad 120 maintains an upward pressure on cable lock members 114 urging lock members 114 to move upward in conical bore section 110. Resilient pad 120 also acts as a spring to allow lock members 114 to move downward slightly relative to insert 106, allowing lock members 114 to separate and passage 16 to expand in diameter when cable 206 is pushed downward through the cylindrical opening 116. When downward movement of cable 206 ceases by cable 206 contacting end plate 104, tension will be applied. As cable 206 starts to move upward, teeth 118 and resilient pad 120 will prevent cable 206 from moving upward relative to lock members 114. Cable lock members 114 will move upward with cable 206, and lower conical bore section 110 causes lock member 114 to move together and forces teeth 118 into cable 206. The diameter of passage 116 will decrease as teeth 118 embed further into cable 206. When upward tension is applied to cable 206, the downward pointing teeth 118 (FIGS. 1 and 2) grab the outer strands of cable 206 to prevent upward movement of cable 206 relative to lock members 114. Increased tension in cable 206 produces increased pressure, by teeth 118 grabbing the cable strands and lock members 114 bearing against lower conical bore section 110. Cable 206 is tightened to the desired tension level and then secured at the top piling segment 200.

Figure 4:
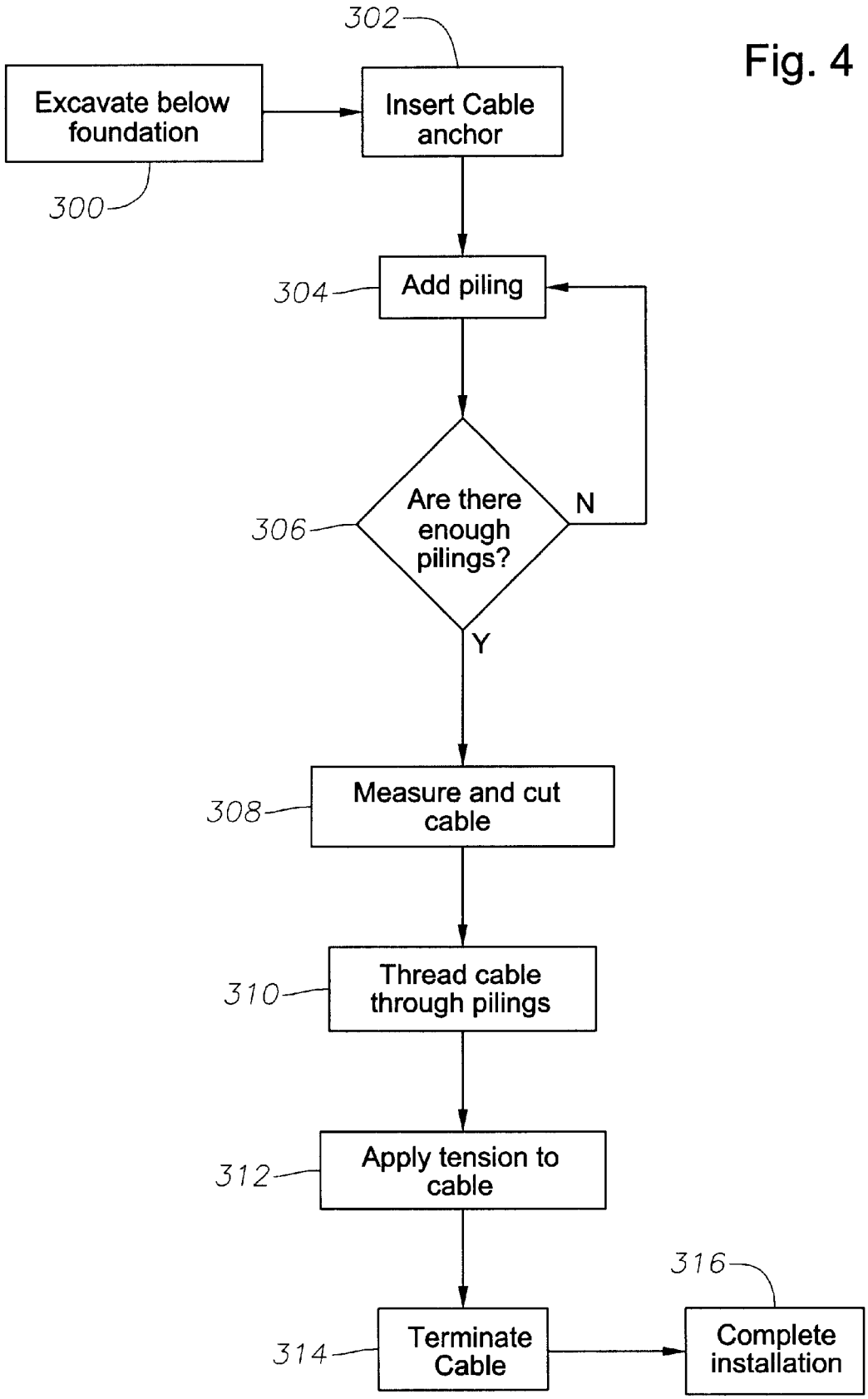
FIG. 4 is a high-level block diagram of a process for post-tensioning segmented pilings in accordance with a preferred embodiment of the present invention.

Referring also to FIG. 4, a high-level block diagram is shown of a process for post-tensioning segmented pilings in accordance with a preferred embodiment of the present invention. The process begins with step 300, which depicts excavation of the earth below and around a foundation that is to be raised. The excavation is done to allow room for the workers to drive segments to construct the piling. The process passes to step 302, which illustrates a cable anchor 100, as described above, being driven into the excavated earth as a first segment. The process then passes to step 304, which depicts adding a piling segment 200 onto the top of the previously installed cable anchor 100. The preformed cable passages 204 in the piling segments 200, as shown in FIG. 3, are aligned with each successive segment.

The process continues to step 306, which illustrates a determination of whether there are enough segments 200 to complete the piling installation. If there are not enough segments 200, the process returns to step 304 and repeats step 304. If the determination is made that there are enough segments 200 installed to complete the piling installation, the process instead passes to step 308, which depicts measuring and cutting the tensioning cable 206 for installation. The number and length of the piling segments 200 are known and the length of cable anchor 100 is known. Therefore the length of cable 206 necessary to complete the tensioning step is known.

The process then moves to step 310, which illustrates the proper length of cable 206 being threaded through the aligned cable passages 204 in piling segments 200 and into cable anchor 100. The process continues to step 312, which depicts applying tension to the installed tensioning cable 206 as described above.

The process then passes to step 314, which illustrates a termination lug (not shown) being applied to the top end of cable 206 to hold the desired tension. Any excess cable 206 is then trimmed and the process proceeds to step 316, which depicts the step of lifting the foundation 210, adding any shims necessary to keep the foundation at the desired level, and returning the excavated earth to the open area beneath the foundation.

Significant labor is saved since a tensioning cable is inserted into a piling in a single operation, after the segmented piling has been driven. The installer is able to cut the cable to the proper length. The excavation of the piling hole is minimized in that the only excavation necessary is that which is needed to receive the piling. The cable is threaded through the piling after the segments are completely installed, and the cable is then tensioned. Also, significantly less working room is required. The length of the piling is known before the cable is installed, allowing the cable to be cut to length on site, avoiding waste and the problems associated with cables that are too short. There is no need to slide piling sections along the cable allowing larger sizes of piling sections to be used.

Labor is also saved because it is not necessary to use a bending template while driving cylinders. There is no need to place the driving ram in an off center position to avoid a cable, which reduces the chance that a piling section will be damaged while being driven and reduces the chance that a piling will deviate from a vertical orientation while being driven.

While the invention has been particularly shown and described with reference to a preferred embodiment, it will be understood by those skilled in the art that various changes in form and detail may be made therein without departing from the spirit and scope of the invention.

What is claimed is:

1. A cable anchor adapted to be located at the bottom of a foundation piling having a plurality of piling segments, each having an aligned hole for receiving a cable, comprising:

a plurality of lock members, each having an outer wall and a partially cylindrical recess formed on an inner wall, the lock members being arranged around a longitudinal axis of the cable anchor so that the recesses combine to define an axially extending lock member passage for receiving an end of the cable;

a cam surface that mates with the lock members so that axial movement of the lock members and the cam surface in a first direction causes the lock member passage to expand to receive an end of the cable, and axial movement of the lock members and the cam surface in a second direction causes the lock member passage to constrict to grip the end of the cable to post-tension the piling; and a resilient member that urges the lock members and the cam surface toward the second direction.

2. The cable anchor of claim 1, further comprising:

a plurality of teeth formed in the recesses to grip the cable.

3. The cable anchor of claim 1, wherein the lock members move downward relative to the cam surface in the first direction and upward relative to the cam surface in the second direction.

4. The cable anchor of claim 1, wherein the cam surface comprises a conical bore section, and the outer wall of each of the lock members slidingly mates with the conical bore section.

5. The cable anchor of claim 1, wherein:

the cam surface comprises a downward facing conical bore section;

the outer wall of each of the lock members is partially conical; and wherein the resilient member is located below the lock members and urges the lock members upward relative to the cam surface.

6. A cable anchor adapted to be located at the bottom of a foundation piling having a plurality of piling segments, each having an aligned hole for receiving a cable, comprising:

a plurality of lock members, each having an outer wall and a partially cylindrical recess formed on an inner wall, the lock members being arranged around a longitudinal axis of the cable anchor so that the recesses combine to define an axially extending lock member passage for receiving an end of the cable; and a cam surface that mates with the lock members so that axial movement of the lock members and the cam surface in a first direction causes the lock member passage to expand to receive an end of the cable, and axial movement of the lock members and the cam surface in a second direction causes the lock member passage to constrict to grip the end of the cable to post-tension the piling;

a cylinder having a bore;

an insert located within the bore of the cylinder, the insert having an axially extending insert passage for receiving an end of the cable, the insert having a downward facing conical bore section that joins the insert passage and serves as the cam surface;

wherein the outer walls of the lock members slidingly engage the conical bore section; and an elastomeric member located below the lock members and having an upper surface that urges the lock members upward in the second direction relative to the conical bore section.

7. A cable anchor adapted to be located at the bottom of a foundation piling having a plurality of piling segments, each having an aligned hole for receiving a cable, comprising:

a downward facing conical surface;

a plurality of lock members, each having an outer wall slidingly mating with the conical surface and a partially cylindrical recess formed on an inner wall, the lock members being arranged around a longitudinal axis of the cable anchor so that the recesses combine to define an axially extending lock member passage for receiving an end of the cable;

a plurality of teeth formed on the recesses for gripping the cable; and a resilient member engaging a lower side of the lock members for urging the lock members upward relative to the conical surface to reduce a diameter of the lock member passage for gripping the cable, the resilient member allowing downward movement of the lock members relative to the conical surface to expand the diameter of the lock member passage for receiving an end of the cable as it is lowered through the piling segments into the cable anchor.

8. The cable anchor of claim 7, wherein the resilient member is elastomeric and has a partially conical side that mates with the conical surface.

9. The cable anchor of claim 7, wherein resilient member is an elastomeric pad that bears against a lower plate, the elastomeric pad having an axially extending pad passage therethrough for receiving the end of the cable, and wherein the lower plate is adapted to be abutted by the end of the cable.

10. The cable anchor of claim 7, further comprising an insert member, the conical surface being formed on a lower side of the insert member, the insert member having an axially extending insert passage that joins the conical surface for receiving an end of the cable.

11. The cable anchor of claim 7, further comprising an insert member, the conical surface being formed on a lower side of the insert member, the insert member having an axially extending insert passage that joins the conical surface for receiving an end of the cable, the insert member having an upward facing conical guide surface extending upward from the insert passage.

* * * * *